US007513616B2

(12) United States Patent
Lin

(10) Patent No.: US 7,513,616 B2
(45) Date of Patent: Apr. 7, 2009

(54) APPARATUS, METHOD AND INK JET PRINTER FOR UTILIZING REFLECTED LIGHT FROM PRINTING MEDIA TO DETERMINE PRINTING MEDIA MATERIAL

(75) Inventor: Yung-Shan Lin, Ping-Tung Hsien (TW)

(73) Assignee: Lite-On Technology Corp., Neihu, Taipei (TW)

( * ) Notice: Subject to any disclaimer, the term of this patent is extended or adjusted under 35 U.S.C. 154(b) by 400 days.

(21) Appl. No.: 11/381,750

(22) Filed: May 5, 2006

(65) Prior Publication Data

US 2007/0091384 A1 Apr. 26, 2007

(30) Foreign Application Priority Data

Oct. 21, 2005 (TW) ..... 94136854 A

(51) Int. Cl.
*B41J 29/393* (2006.01)
*B41J 2/01* (2006.01)

(52) U.S. Cl. ..... 347/105; 347/19

(58) Field of Classification Search ..... 347/19, 347/105
See application file for complete search history.

(56) References Cited

U.S. PATENT DOCUMENTS

| | | | | |
|---|---|---|---|---|
| 6,914,684 | B1 * | 7/2005 | Bolash et al. | 347/105 |
| 2003/0015025 | A1 | 1/2003 | Lindig | |
| 2003/0193034 | A1 * | 10/2003 | Tullis et al. | 250/559.16 |
| 2004/0129901 | A1 | 7/2004 | Yamaguchi | |

* cited by examiner

*Primary Examiner*—Julian D Huffman
(74) *Attorney, Agent, or Firm*—Winston Hsu

(57) ABSTRACT

An apparatus for determining a printing media material, includes a light source for exposing the printing media to light; an image sensor for sensing reflected light from the printing media to form at least one image corresponding to the printing media; and an image-analyzing unit, electrically connected to the image sensor, for analyzing the image to generate a material parameter and then determining the printing media material according to the material parameter.

14 Claims, 7 Drawing Sheets

APPARATUS, METHOD AND INK JET PRINTER FOR UTILIZING REFLECTED LIGHT FROM PRINTING MEDIA TO DETERMINE PRINTING MEDIA MATERIAL

BACKGROUND OF THE INVENTION

1. Field of the Invention

The present invention provides an apparatus and a method capable of determining the material of a printing media, and in particular, an apparatus and a method that detects reflected light from the printing media to form an image, and analyzes the image to determine the material of the printing media. Furthermore, the present invention also introduces an ink jet printer that applies the disclosed apparatus and the method.

2. Description of the Prior Art

In a general case, when a printer prints a media, a notable quality difference will exist between different materials. With an ink jet printer for example, photo paper has good performance but the pattern on normal paper is often blurred due to ink spread. Before printing, users have to manually set the material and type setting of printing media at such as photo paper, normal paper, or a slide etc. The printer adjusts the ink jet head to jet ink at a suitable speed and amount according to the material parameter set by users, in order to achieve the best print performance. If the material and type of printing media is not set before printing, bad print performance may occur. While it is possible to reprint when a bad print performance occurs, this is inconvenient and inefficient, and results in meaningless paper waste.

In the related art, a plurality of light sources and a light receiver (or a light source and a plurality of light receivers) are utilized to receive reflected light and transmission light from the printing media and then compare the light vectors at a co-ordinate axis in order to analyze the material of the printing media. Another method locates a rotatable circular wheel that includes a fillister behind the printing media, and determines the material of the printing media through monitoring a pattern generated by the reflected light from the circular wheel. The methods discussed above require complex mechanical structures and devices to obtain the desired result, resulting in high manufacturing costs.

SUMMARY OF THE INVENTION

It is therefore one objective of the present invention to provide an apparatus and a method for determining a printing media material. The present invention also introduces an ink jet printer for applying the apparatus and the method. The ink jet printer is capable of automatically determining the material of the printing media without manual settings, to solve the above-mentioned problems.

According to an embodiment of the present invention, an apparatus for determining the printing media material is disclosed. The apparatus includes a light source for generating light to expose the printing media; an image sensor for detecting reflected light from the printing media to generate at least one image corresponding to the printing media; and an image-analyzing unit, electrically connected to the image sensor, for analyzing the image to obtain a material parameter, then determining the material of the printing media according to the material parameter.

According to an embodiment of the present invention, a method for determining the printing media material is disclosed. The method includes exposing the printing media; detecting reflected light from the printing media to generate at least one image corresponding to the printing media; and analyzing the image of the printing media to obtain a material parameter, then determining the printing media material according to the material parameter.

According to an embodiment of the present invention, an ink jet printer for determining the printing media material is disclosed. The ink jet printer includes a light source for generating light to expose the printing media; an image sensor for detecting reflected light from the printing media to generate at least one image corresponding to the printing media; an image-analyzing unit, electrically connected to the image sensor, for analyzing the image to obtain a material parameter and then determining the material of the printing media according to the material parameter; a printing control module, electrically connected to the image-analyzing unit, for setting a printing parameter according to the material of the printing media; and at least one inkjet print head, electrically connected to the printing control module, for determining an ink-jetting model of the ink jet printer according to the printing parameter.

The present invention discloses an apparatus that determines the material of the printing media through utilizing a light source to expose the printing media and then detects reflected light from the printing media to generate an image corresponding to the printing media. The image includes information relating to the printing media; therefore a material parameter related to the material of the printing media is obtained by analyzing the image. Through appropriate analysis of the material parameter, the material of the printing media can be substantially determined. The ink jet printer disclosed in the present invention utilizes the mechanism to automatically determine the material of the printing media before the ink jet printer prints the media. As there is no need for a manual setting by users, the present invention improves the convenience and quality of printing.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
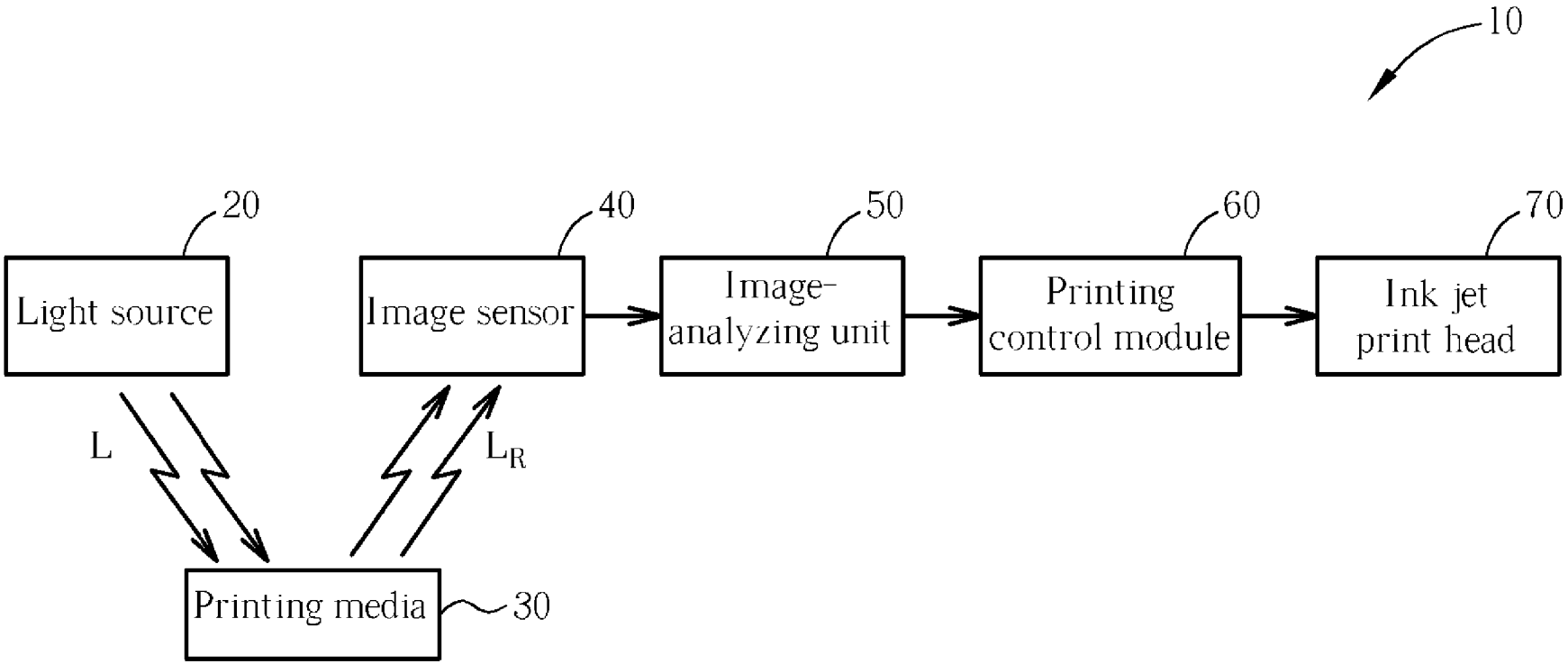
FIG. 1 is a diagram of an ink jet printer according to one embodiment of the present invention.

Please refer to FIG. 1. FIG. 1 is a diagram of an ink jet printer according to one embodiment of the present invention. As shown in FIG. 1, the inkjet printer 10 includes a light source 20, an image sensor 40, an image-analyzing unit 50, a printing control module 60, and an ink jet print head 70. The light source 20, the image sensor 40, and the image-analyzing unit 50 are combined to form a determinant apparatus for determining the material of a printing media 30. The combination and operation principle are discussed in the following. When the ink jet printer 10 starts to print, the light source 20 (such as a light emitting diode (LED)) provides light L to expose the printing media 30, and the printing media 30 reflects the light L to generate reflected light $L_R$. The image sensor 40 receives the reflected light $L_R$ and generates an image corresponding to the material of the printing media 30, then transmits the image to the image-analyzing unit 50. Next, the image-analyzing unit 50 analyzes the image and determines the material of the printing media 30. The printing control module 60 then sets a printing parameter according to the material of the printing media 30. Finally, the inkjet print head 70 determines a print model of the printing media 30 according to the print parameter. For example, the print model includes setting values such as ink amount and jet speed. In the print procedure, the ink jet printer 10 automatically detects the material of the printing media 30 (such as photo paper, normal paper, slides etc.) and then sets the print parameter according to the material of the printing media 30 in order to achieve the best print performance.

Figure 2:
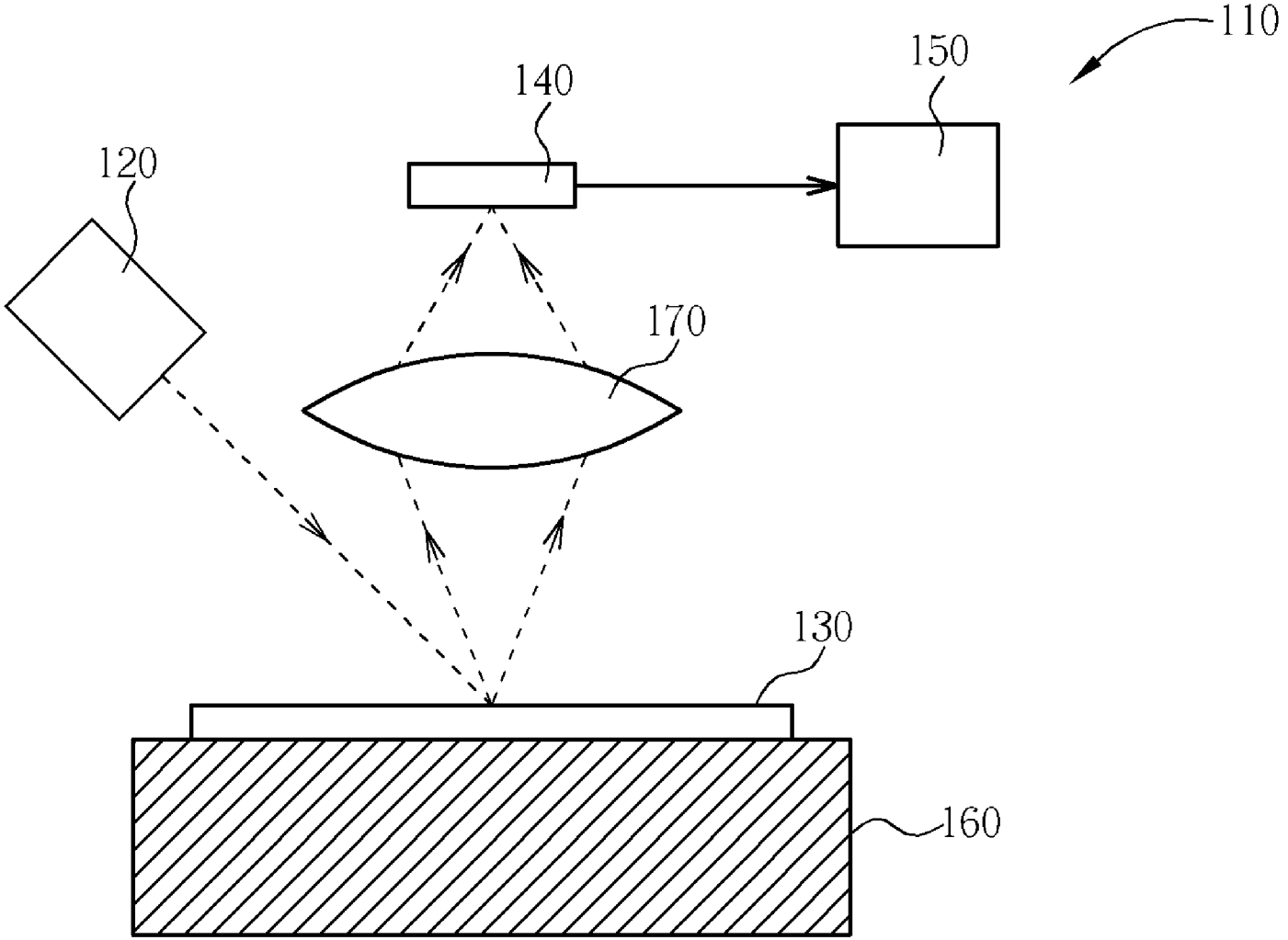
FIG. 2 is a diagram of the apparatus according to a preferred embodiment of the present invention.

In FIG. 1, the light source 20, the image sensor 40, and the image-analyzing unit 50 are combined to form the determinant apparatus. It should be noted that this is only one example of the present invention, and the combination of the determinant apparatus is not limited by this example. Please refer to FIG. 2. FIG. 2 is a diagram of the determinant apparatus 110 according to a preferred embodiment of the present invention. As FIG. 2 shows, the apparatus 110 includes a light source 120 for generating light to expose the printing media 130; an image sensor 140 for detecting the reflected light reflected from the printing media 130 to generate at least one image corresponding to the printing media 130; a lens 170 for gathering the reflected light from the printing media 130 to focus on the image sensor 140; and an image-analyzing unit 150 for analyzing the image to obtain a material parameter, thereby determining the material of the printing media 130 according to the material parameter. At the beginning of the operation, the light source 120 generates light to expose the printing media 130, wherein the printing media 130 is positioned on a dark platform 160, so it can reflect light. Obviously, the intensity of the reflected light is related to the material of the printing media 130. For example, the material of photo paper is smooth, so the reflected light intensity is strong; but a slide is a transparent object, so the reflected light is mainly absorbed by the dark platform 160 (such as a black platform) under the slide. The reflected light intensity of the slide is therefore decreased substantially. As mentioned above, the reflected light intensity relates to information about the material of the printing media 130. In order to accurately analyze the reflected light, a lens 170 is positioned at the route of the reflected light to focus the reflected light on the image sensor 140. Next, the image sensor 140 transforms the reflected light intensity into an image and the image-analyzing unit 150 then analyzes the image to obtain a material parameter corresponding to the printing media 130. Finally, the image-analyzing unit 150 can determine the material of the printing media 130 according to the material parameter. To improve determinant accuracy, the apparatus 110 in the preferred embodiment includes the lens 170, although the lens 170 is not a necessary device. The lens 170 is positioned in the apparatus 110 according to design requirements.

Figure 3:
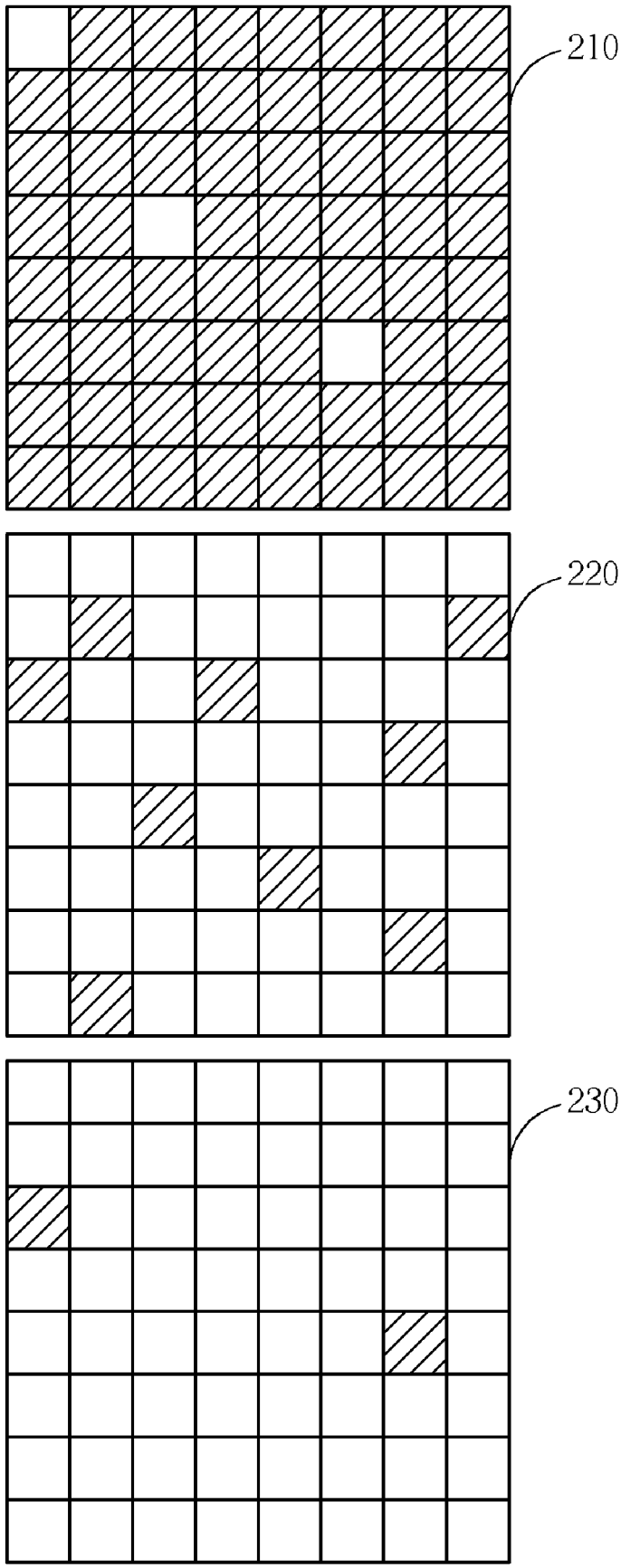
FIG. 3 is a diagram of the image transformed from the reflected light gathered by the image sensor in the apparatus shown in FIG. 2.

Please refer to FIG. 2 and FIG. 3. FIG. 3 shows the image transformed from the reflected light gathered by the image sensor 140 in the apparatus 110 shown in FIG. 2. The image sensor 140 can be realized by several kinds of optical sensors and this embodiment takes a usual image sensor that transforms light into a 2-dimensional image as an example. The images scanned by the image sensor 140 are 2-dimensional (2-D) images 210, 220, and 230 shown in FIG. 3. The 2-D images 210, 220, and 230 include a plurality of pixels, wherein the pixels are divided into bright dots and dark dots according to their light intensity. The image-analyzing unit 150 calculates a material parameter according to the number ratio of bright dots and dark dots in the 2-D images 210, 220, and 230 and then compares the material parameter with a threshold value set. According to the proportions between the material parameter and the threshold values, the image-analyzing unit 150 is capable of determining the material of the printing media 130. In general, the threshold values are electronic signals such as voltage values or current values. For example, users can set a rule such as the material parameter is directly proportional to the bright dot numbers. Through utilizing a simple comparison circuit, it can be known that the material parameter is located between two greater voltage values in the threshold value set, and it can therefore be determined that the reflected light intensity is great. That is, the printing media 130 is likely to be a smooth photo paper such as the 2-D image 230 shown in FIG. 3. On the other hand, if the material parameter is located between two lesser voltage values in the threshold value set, it can be determined that the reflected light intensity is weak (as shown in the 2-D image 220 shown in FIG. 3). That is, the printing media 130 is likely to be rough material such as reprocessed (recycled) paper. If the printing media 130 is transparent (such as a slide), due to the printing media 130 being positioned on the dark platform 160, the corresponding 2-D image will be similar to the 2-D image 210 shown in FIG. 3. The 2-D image 210 contains nearly all dark dots, so the material parameter is less than a preset minimum voltage value.

Figure 4:
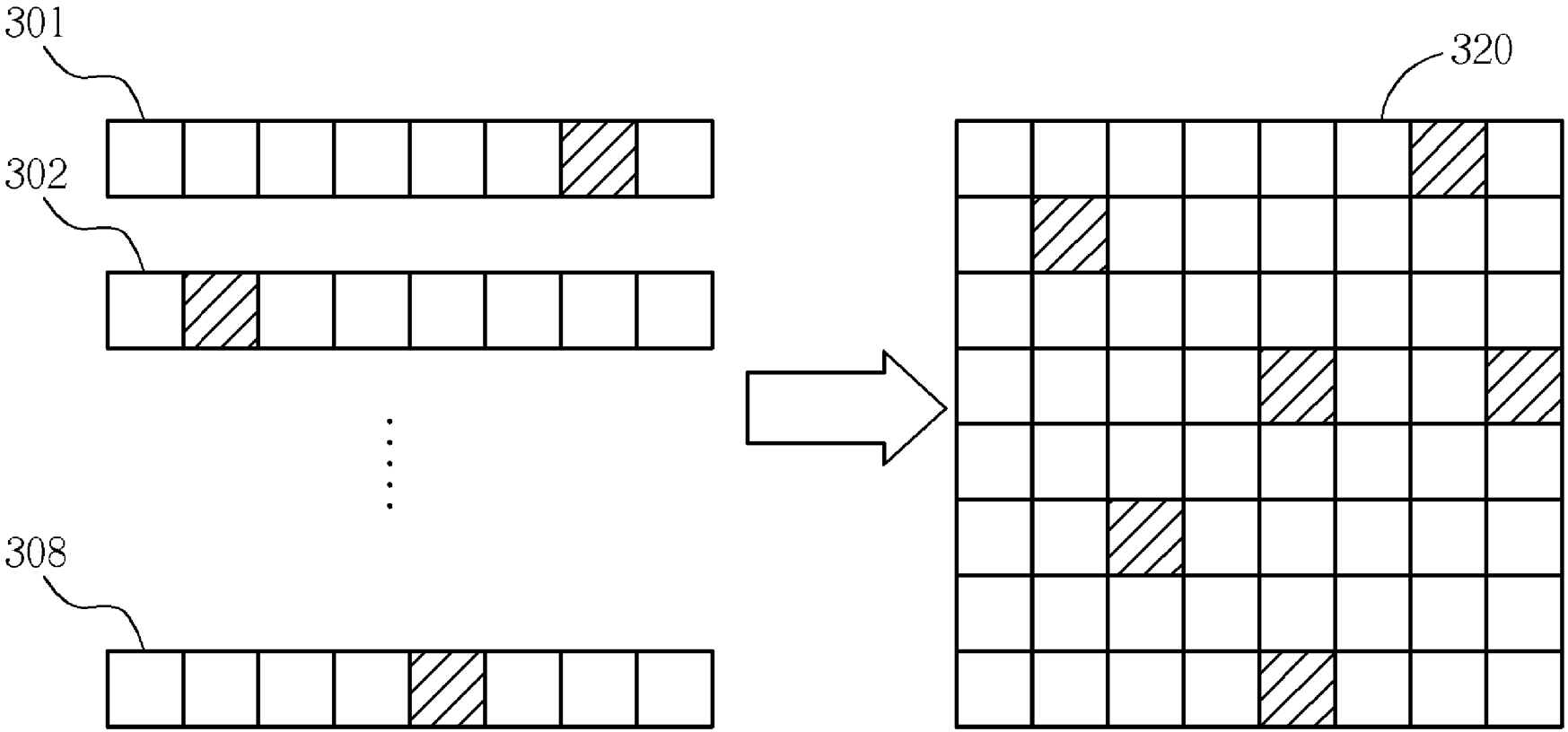
FIG. 4 is a diagram of the image transformed from the reflected light gathered by the contact image sensor in the apparatus shown in FIG. 2.

Please note that the image sensor 140 in this embodiment can be accomplished through a 1-dimensional (1-D) optical sensor, such as a contact image sensor (CIS). The difference between the CIS and the above-discussed 2-D image sensor is that the lens 170 used in the CIS is using a row of gradient index (GRIN) lens. Please refer to FIG. 2 and FIG. 4. FIG. 4 is a diagram of the image transformed from the reflected light gathered by the CIS in the apparatus 110. Because the CIS utilizes a 1-D (linear) scanning method to detect the reflected light from the printing media 130, the CIS continuously scans several neighboring lines in a section and then inputs these 1-D images 301-308 into the image-analyzing unit 150. The image-analyzing unit 150 combines the neighboring lines scanned by the CIS to construct a 2-D image 320 and utilizes the method that determines the material of the printing media 130 according to the 2-D image mentioned above to determine the material of the printing media 130.

Figure 5:
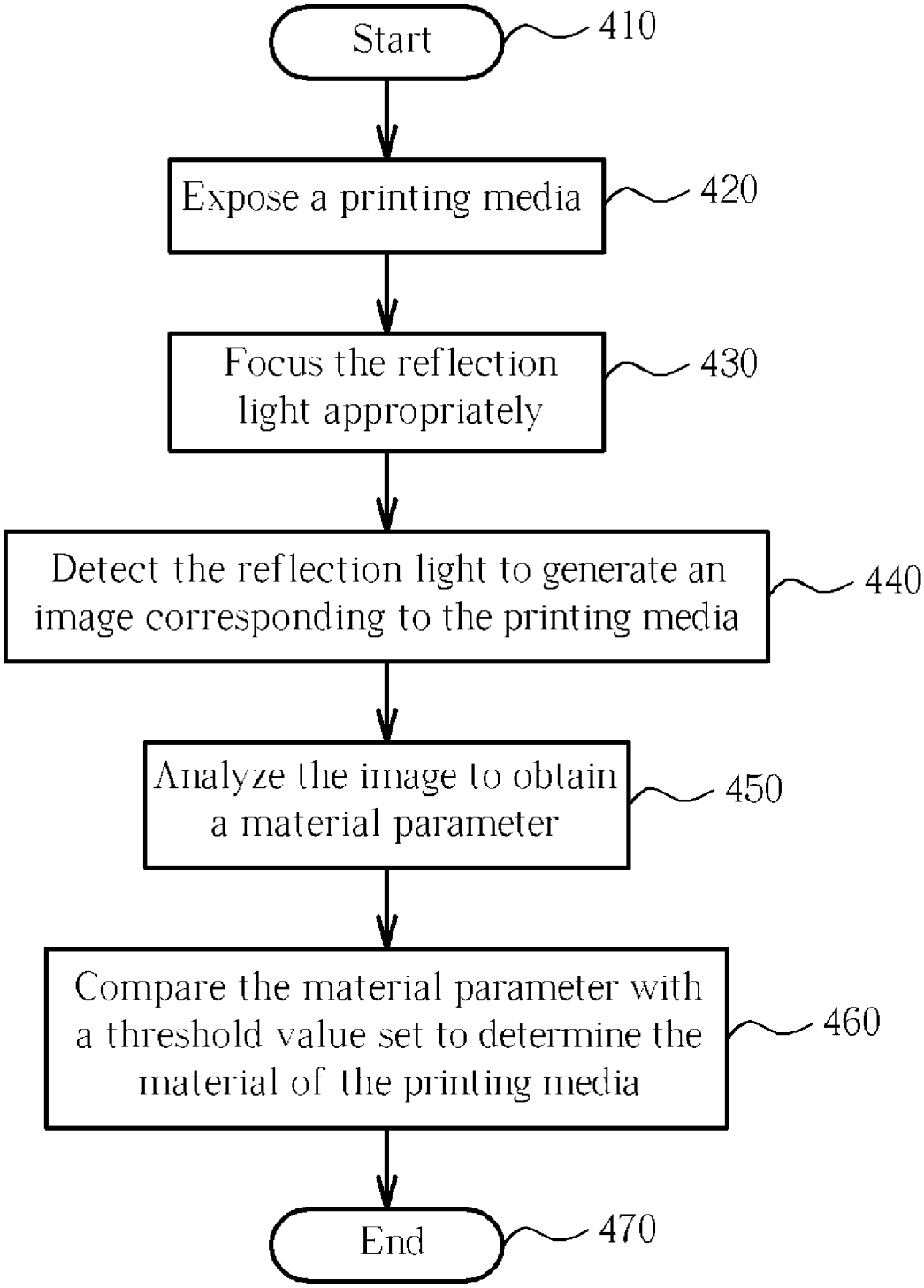
FIG. 5 is a flowchart of the method of determining the material of the printing media shown in FIG. 2 according to a first embodiment of the present invention.

Please refer to FIG. 2 and FIG. 5. FIG. 5 is a flowchart of the method of determining the material of the printing media 130 shown in FIG. 2 according to the first embodiment of the present invention. The procedure is described in the following steps:

Step 410: start;

Step 420: utilize a light source 120 to expose a printing media 130;

Step 430: utilize a lens 170 to appropriately focus the reflected light from the printing media 130 to generate a clear image;

Step 440: utilize an image sensor 140 to detect the reflected light intensity and gather an image corresponding to a specific position on the printing media 130;

Step 450: utilize an image-analyzing unit 150 to analyze the image to obtain a material parameter;

Step 460: utilize the image-analyzing unit 150 to compare the material parameter with a threshold value set (such as voltage values or current values) to determine the material of the printing media 130;

Step 470: end.

Figure 6:
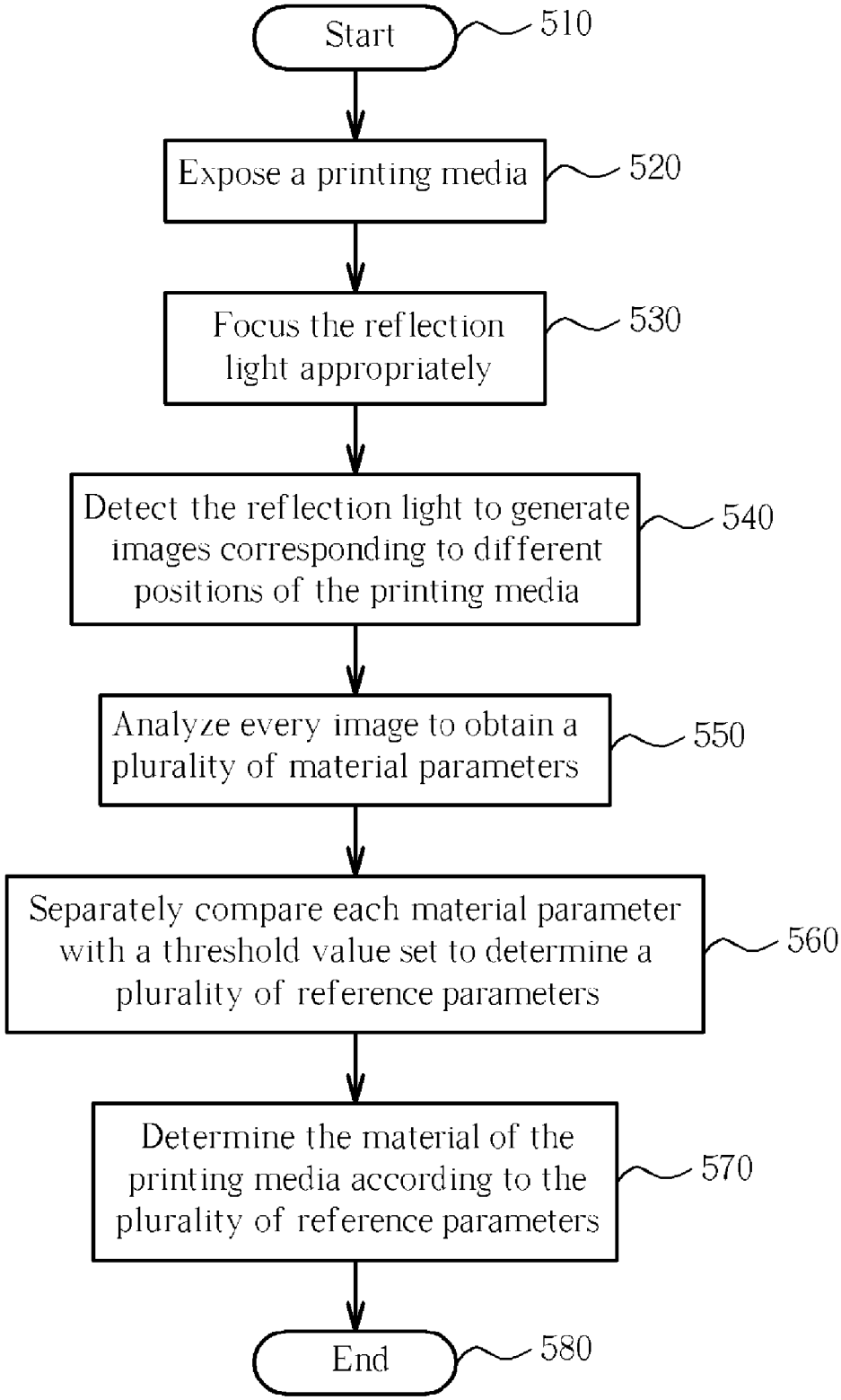
FIG. 6 is a flowchart of the method of determining the material of the printing media shown in FIG. 2 according to a second embodiment of the present invention.

The above determinant mechanism is one embodiment of the present invention, but it is also possible to apply other mechanisms to determine the material of the printing media 130. For example, to accurately determine the material of the printing media 130, the image sensor 140 is capable of detecting the reflected light from several different positions separately on the printing media 130 in order to gather a plurality of images and obtain a plurality of material parameters according to the plurality of images. The image-analyzing unit 150 individually compares the plurality of material parameters with a threshold value set to determine a plurality of reference parameters, and then determines the material of the printing media 130 according to the plurality of reference parameters. Please refer to FIG. 2 and FIG. 6. FIG. 6 is a flowchart of the method of determining the material of the printing media 130 shown in FIG. 2 according to the second embodiment of the present invention. The steps are explicitly discussed in the following.

Step 510: start;

Step 520: utilize a light source 120 to expose a printing media 130;

Step 530: utilize a lens 170 to appropriately focus the reflected light from the printing media 130 to generate a clear image;

Step 540: utilize an image sensor 140 to detect the reflected light intensity and gather a plurality of images corresponding to several different positions on the printing media 130;

Step 550: utilize an image-analyzing unit 150 to analyze every image to obtain a plurality of material parameters;

Step 560: utilize the image-analyzing unit 150 to compare every material parameter with a threshold value set (such as voltage values or current values) to determine a plurality of reference parameters;

Step 570: utilize the image-analyzing unit 150 to determine the material of the printing media 130 according to the plurality of the reference parameters and the threshold value set;

Step 580: end.

An example for better illustrating the present invention will be detailed herein. Assume the image sensor 140 gathers ten image pictures corresponding to different positions of the same printing media 130. The image-analyzing unit 150 will generate ten material parameters in accordance with the ratios of bright dots and dark dots of the ten image pictures, and then separately compare the ten material parameters with a voltage value set. If there are seven material parameters between the first and second voltage values, the image-analyzing unit 150 generates a first reference parameter (for example, averaging the seven material parameters to generate the first reference parameter) so the first reference parameter is also between the first and second voltage values; other two material parameters are between the second and third voltage values, the image-analyzing unit 150 generates a second reference parameter, so the second reference parameter is between the second and third voltage values; and the rest of the material parameters is between the third and fourth voltage values, the image-analyzing unit 150 generates a third reference parameter, so the third reference parameter is between the third and fourth voltage values. Through analyzing the distribution relationship of these ten material parameters in the threshold value set, it is obvious that most material parameters are located between the first and second voltage values. Therefore the first reference parameter located between the first and second voltage values can be the representation of the material of the printing media 130. If the first and second voltage values represent that the number of the bright dots is greater than the number of the dark dots, then the printing media 130 can be determined to be made by a smooth material such as a photo paper. On the other side, if the first and second voltage values represent that the number of the bright dots is less than the number of the dark dots, then the printing media 130 can be determined to be made by a rough material such as a reprocessed paper.

Figure 7:
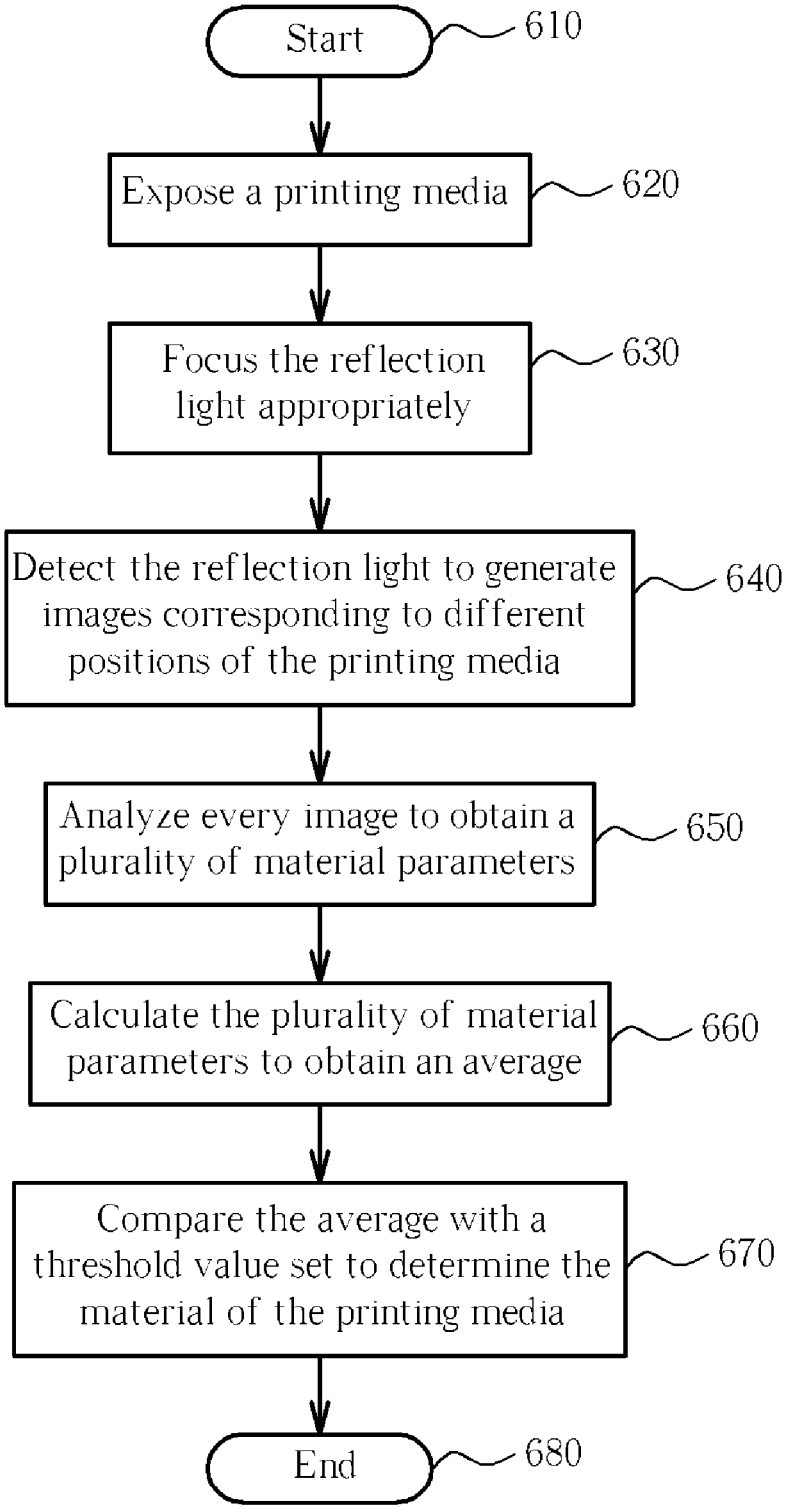
FIG. 7 is a flowchart of the method of determining the material of the printing media shown in FIG. 2 according to a third embodiment of the present invention.

Another method for determining the material of the printing media 130 according to a plurality of images is: obtaining an average of the material parameters corresponding to the plurality of images and then comparing the average with a threshold value set to determine the material of the printing media 130. Please refer to FIG. 2 and FIG. 7. FIG. 7 is a flowchart illustrating the method of determining the material of the printing media 130 shown in FIG. 2 according to the third embodiment of the present invention. The steps are explicitly discussed in the following.

Step 610: start;

Step 620: utilize a light source 120 to expose a printing media 130;

Step 630: utilize a lens 170 to appropriately focus the reflected light from the printing media 130 to generate a clear image;

Step 640: utilize an image sensor 140 to detect the reflected light intensity and gather a plurality of images corresponding to several different positions on the printing media 130;

Step 650: utilize an image-analyzing unit 150 to analyze every image to obtain a plurality of material parameters;

Step 660: utilize the image-analyzing unit 150 to obtain an average of the plurality of material parameters;

Step 670: utilize the image-analyzing unit 150 to compare the average with a threshold value set (such as voltage values or current values) to determine the material of the printing media 130;

Step 680: end.

Due to the average of the plurality of material parameters representing substantial characteristics of the printing media 130, it is possible to determine the material of the printing media 130 from this value. For example, the image sensor 140 gathers ten image pictures corresponding to different positions of the same printing media 130. Next, the image-analyzing unit 150 generates ten material parameters in accordance with the ratios of bright dots and dark dots of the ten image pictures, and then calculates the ten material parameters to obtain an average. Again, if the average is located between two greater voltage values in the threshold value set, the printing media 130 can be determined to be made by a smooth material such as photo paper; if the average is located between two lesser voltage values in the threshold value set, then the printing media 130 can be determined to be made by a rough material such as reprocessed paper.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An apparatus for determining the material of a printing media, the apparatus comprising:

a light source for generating light to expose the printing media;

an image sensor for detecting reflected light from the printing media to generate at least one image corresponding to the printing media;

an image-analyzing unit, electrically connected to the image sensor, for analyzing the image to generate a material parameter and then determining the material of the printing media according to the material parameter; and a gradient index (GRIN) lens for gathering the reflected light from the printing media to focus on the contact image sensor;

wherein the image sensor is a contact image sensor (CIS).

2. The apparatus of claim 1, wherein the light source is a light emitting diode (LED).

3. The apparatus of claim 1, wherein the image-analyzing unit compares the material parameter with a threshold value set to determine the material of the printing media.

4. The apparatus of claim 3, wherein the threshold value set is a voltage value set or a current value set.

5. The apparatus of claim 1, wherein the image sensor gathers a plurality of images corresponding to different positions of the printing media, and the image-analyzing unit analyzes the plurality of images to generate a plurality of corresponding material parameters, then determines the material of the printing media according to the plurality of material parameters.

6. The apparatus of claim 5, wherein the image-analyzing unit compares the plurality of material parameters with a threshold value set to determine a plurality of reference parameters, and then determines the material of the printing media according to the plurality of reference parameters.

7. The apparatus of claim 5, wherein the image-analyzing unit calculates the plurality of material parameters to generate an average and then compares the average with a threshold value set to determine the material of the printing media.

8. An ink jet printer capable of determining the material of a printing media, the ink jet printer comprising:

a light source for generating light to expose the printing media;

an image sensor for detecting reflected light from the printing media to generate at least one image corresponding to the printing media;

an image-analyzing unit, electrically connected to the image sensor, for analyzing the image to generate a material parameter and then determining the material of the printing media according to the material parameter;

a printing control module, electrically connected to the image-analyzing unit, for setting a printing parameter according to the material of the printing media;

at least one ink jet print head, electrically connected to the printing control module, for determining an ink-jetting model of the ink jet printer according to the printing parameter; and a gradient index (GRIN) lens for gathering the reflected light from the printing media to focus on the contact image sensor;

wherein the image sensor is a contact image sensor (CIS).

9. The ink jet printer of claim 8, wherein the light source is a light emitting diode (LED).

10. The ink jet printer of claim 8, wherein the image-analyzing unit compares the material parameter with a threshold value set to determine the material of the printing media.

11. The apparatus of claim 10, wherein the threshold value set is a voltage value set or a current value set.

12. The ink jet printer of claim 8, wherein the image sensor gathers a plurality of images corresponding to different positions of the printing media, and the image-analyzing unit analyzes the plurality of images to generate a plurality of corresponding material parameters, then determines the material of the printing media according to the plurality of material parameters.

13. The ink jet printer of claim 12, wherein the image-analyzing unit compares the plurality of material parameters with a threshold value set to determine a plurality of reference parameters, and then determines the material of the printing media according to the plurality of reference parameters.

14. The ink jet printer of claim 12, wherein the image-analyzing unit calculates the plurality of material parameters to generate an average and then compares the average with a threshold value set to determine the material of the printing media.

* * * * *